United States Patent [19]

Clokey

[11] 4,196,541

[45] Apr. 8, 1980

[54] REINFORCED ARTICLES OF ELASTOMERIC MATERIAL

[76] Inventor: Arthur C. Clokey, 20969 Colina Dr., Topanga, Calif. 90290

[21] Appl. No.: 927,422

[22] Filed: Jul. 24, 1978

Related U.S. Application Data

[63] Continuation-in-part of Ser. No. 785,488, Apr. 7, 1977, Pat. No. 4,112,614.

[51] Int. Cl.[2] ..... A63H 3/36

[52] U.S. Cl. ..... 46/164; 46/162; 46/135 R

[58] Field of Search ..... 46/162, 1 F, 135 R, 46/135 A, 156, 164, 165, 151, 167

[56] References Cited

U.S. PATENT DOCUMENTS

| | | | |
|---|---|---|---|
| 885,802 | 4/1908 | Sterrick | 46/1 F |
| 2,045,962 | 6/1936 | Rastetter | 46/135 R |
| 2,109,422 | 2/1938 | Haughton | 46/135 R |
| 4,112,614 | 9/1978 | Clokey | 46/164 |

FOREIGN PATENT DOCUMENTS

| | | | |
|---|---|---|---|
| 984694 | 3/1965 | United Kingdom | 46/151 |

*Primary Examiner*—Louis G. Mancene

[57] ABSTRACT

The present invention relates to improvements in facial likenesses or caricatures made of elastomeric materials and reinforced with wire in a manner such that the facial position can be manipulated to selectively alter the expression or appearance thereof and is particularly concerned with an improved eye socket structure and reinforcement therefor.

9 Claims, 5 Drawing Figures

REINFORCED ARTICLES OF ELASTOMERIC MATERIAL

The present application is a continuation-in-part of my co-pending application U.S. Ser. No. 785,488 filed Apr. 7, 1977, U.S. Pat. No. 4,112,614.

The present invention relates to the art of manufacture of articles such as facial likenesses or caricatures made of elastomeric resilient materials such as rubber or plastics which can be cast or molded.

BACKGROUND OF THE INVENTION

The art of casting or molding of articles made from resilient rubber or plastic materials is well developed and facial likenesses of known or fictitious characters can of course be made therefrom. While resilient materials of this type can be readily deformed, due to the elastic memory of the materials of which the caricatures are manufactured, only a single facial expression has heretofore been attainable.

Relevant prior art known to applicant comprises U.S. Pat. No. 2,109,422, Haughton; U.S. Pat. No. 3,624,691, Robson et al; and U.S. Pat. No. 3,061,880, Weisbach.

It is an objective of the present invention to provide a facial likeness or caricature in which the facial expression can be selectively changed by simple manipulation of the caricature and, more specifically, the present invention is directed to the provision of an improved eye socket structure for such facial likenesses or caricatures.

BRIEF SUMMARY OF THE INVENTION

The present invention accordingly provides an article of elastomeric material having a facial portion in the form of a facial likeness or a caricature capable of assuming a variety of different facial expressions, said article having eye portions and deformable reinforcement embedded in the elastomeric material and said facial portion, said reinforcement being capable of being manually manipulated to hold the elastomeric material in the selected facial expression, said reinforcement comprising a first reinforcing member extending substantially around the periphery of the facial portion of the article and a second reinforcing member generally in the form of an open ended rectangular loop having its spaced end portion extending transversely across the facial portion of the article and located behind the eyes, said second reinforcing member being affixed to said first reinforcing member.

The advantages and the objectives of the present invention are attained in the following description of a preferred embodiment.

DETAILED DESCRIPTION

Articles according to the present invention can be made of any suitable non-toxic resilient rubber or plastic material which can be cast in a mold. Non-toxicity of the plastic material is not an essential characteristic but is highly desirable since articles constructed according to the present invention will frequently be used as toy items where they can be subjected to use by children thus non-toxicity of each material is highly desirable.

Figure 1:
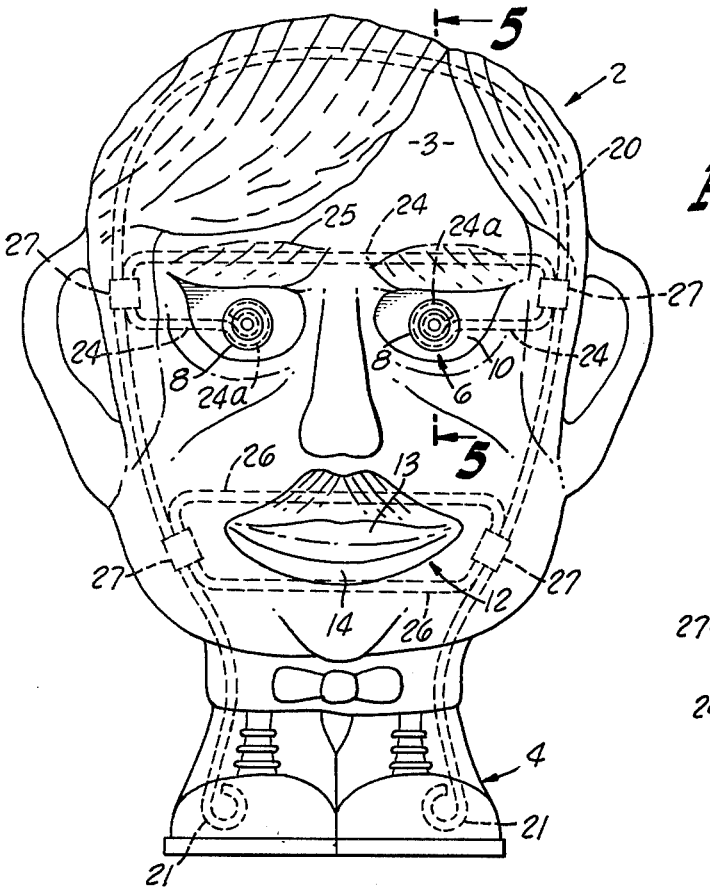
FIG. 1 comprises a front view of a caricature constructed in accordance with the preferred embodiment and shows the external features thereof.

In FIG. 1 is shown a facial caricature 2 including all of the usual facial features and in which a face 3 is shown immediately adjacent a pair of feet 4. It will of course be appreciated that any shape of the caricature can be used with or without feet adjacent to the face 3. As can be seen from FIGS. 1 and 5, the eyes 6 will comprise generally cylindrical or conical projections 8 which are inset into the face 3 in a recessed area 10. Such construction enables the eyes 6 to be protruded forwardly from the face 3 to the dashed line position shown in FIGS. 4 and 5 by manipulation from the rear of the article as will be described subsequently in greater detail.

Figure 4:
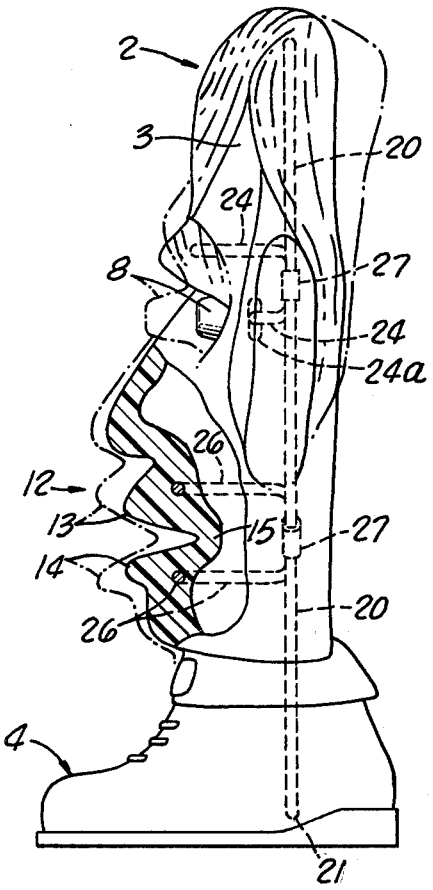
FIG. 4 is a profile or side view, partly in section, of the caricature shown in FIG. 1.

As also seen in FIG. 1, the mouth 12 is shown to comprise separate upper and lower lips 13, 14 which extend forwardly and which are generally parallel to each other. Reference is here made to FIG. 4 which is the profile view, partially in section, showing the spacing of the lips 13, 14 from each other. Also shown in dashed line position in FIG. 4 is the location to which the eyes 6 and lips 13, 14 can be forwardly protruded if desired.

Figure 2:
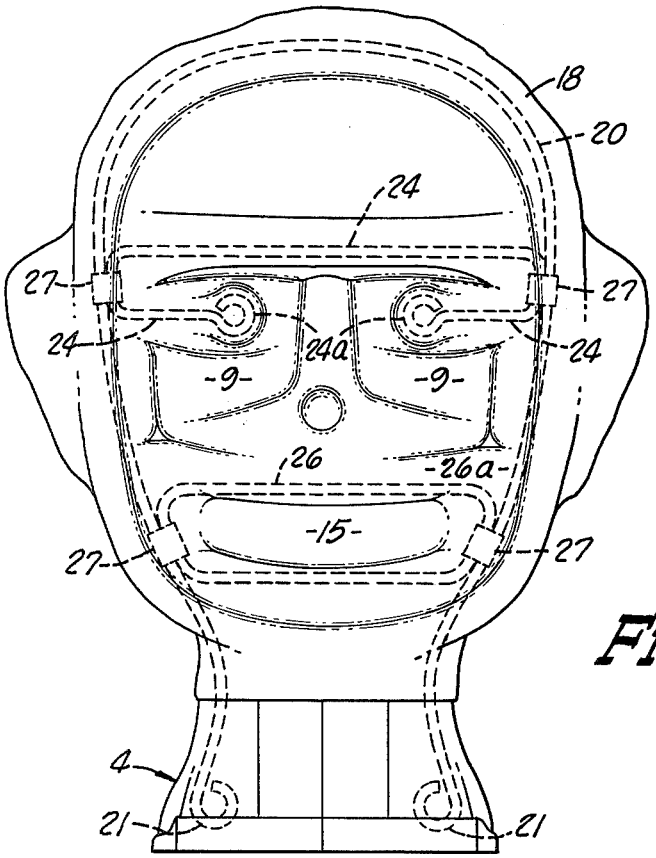
FIG. 2 comprises a rear view showing built-up areas in which the resilient rubber or plastic material is thickened and reinforced.

As seen in FIG. 2, the rear portion of the face portion of the article includes a generally concave cavity 16. The facial portion has a thickened periphery 18 extending therearound for reception of a peripheral reinforcement 20 which may be a wire. The peripheral reinforcement 20 includes two end portions each having a suitably configured anchor 21 which is embedded in the material immediately below the facial portion of the article as shown. A second reinforcement wire 24 which may be in the form of a generally rectangular loop having spaced ends 24*a* is located in the facial portion of the article as shown to provide reinforcing at the area adjacent the eyebrows 25 and in the area behind the eyes 6 as shown. A third reinforcing wire 26 in the form of a generally rectangular loop 26 is located as shown to provide transverse reinforcement for the upper lip 13 and the area adjacent the lower lip 14.

Wires 20, 24 and 26 are affixed together where shown by metallic clips 27.

All of the reinforcing wires 20, 24, 26 will be made of a deformable wire which preferably comprises a stainless steel annealed alloy which is corrosion free. Such wire can be readily deformed and will hold its selected shape. Preferably a non-toxic coating of high density polyethylene will be used on the wire which is embedded in the resilient material of which the article is made.

Again referring to FIG. 2, it can be seen that the areas in which the wires 24, 26 respectively are embedded are constructed to be somewhat thicker or more massive than the remainder of the article in order to provide an adequate thickness of material surrounding each reinforcing wire. Also, each eye cone 8 is mounted on a boss or wall 9 of relatively thin material so that depression from the rear of the face of the boss or wall 9 will readily cause the eye cones 8 to be protruded forwardly. Similarly, a boss 15 extends in the cavity immediately behind the mouth 12 such that depression of the boss 15 will cause a change in configuration of the mouth 12. It has been found that the thin wall 9 surrounding each eye cone 8 permits flexibility of the eyes and variety of expression not heretofore attainable.

Figure 3:
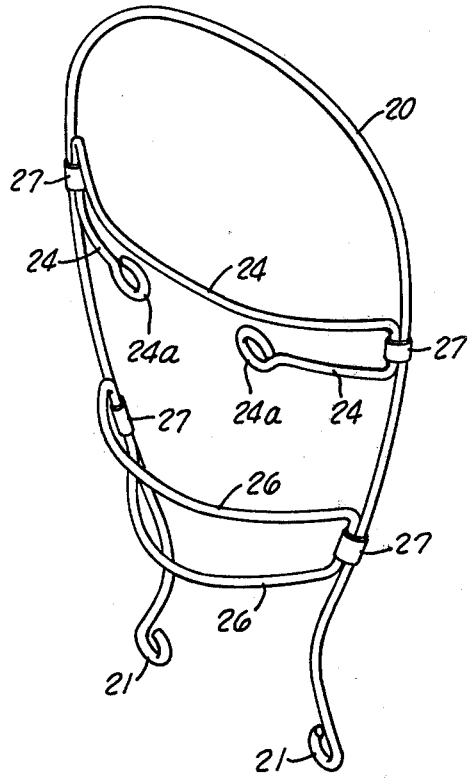
FIG. 3 is a perspective view showing the reinforcement.

For clarity in illustration, the reinforcement is shown separately in FIG. 3. While three separate pieces of reinforcing wire 20, 24, 26 have been shown it will be appreciated by persons skilled in the art that different patterns of reinforcement may be more appropriate for different usages. In the preferred embodiment, the reinforcing wires are welded or otherwise affixed together as by metal clips 27 before they are embedded in the resilient material during the casting or molding process. Thus, the reinforcing wires will not become detached from each other but will remain capable of assuming whichever position is desired.

Figure 5:
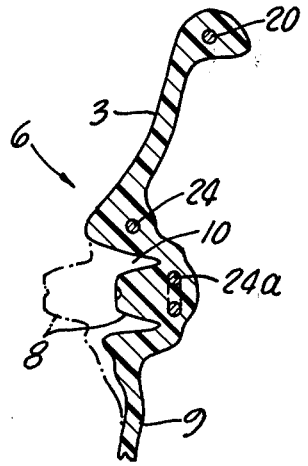
FIG. 5 is a cross section of the eye cavity or cone taken along lines 5—5 in FIG. 1.

It has been found that the construction of the open ended loop of wire 24 with spaced ends **24*a* located behind each eye 6 and embedded as shown in conical projections 8 enables the character to assume a variety of eye configurations including, but not limited to, a wink or squint (as by locating one end 24*a* of wire loop 24 higher or lower than the other) and "eyes forward" positions as seen in dashed line position in FIG. 5 or "eyes rear" position as shown in solid line position in FIG. 5. Preferably the ends 24*a* of loop of wire 24** are each beat into a closed eye so as to avoid sharp ends of wire embedded in the elastomeric material.

The type of elastomeric material, thickness thereof and type of wire must be selected together to ensure that the finished article can be readily manipulated by hand to selectively alter the facial expressions. Thus the wire must be stiff enough to hold the elastomeric material in the desired shape yet the wire must be flexible enough so that it can be easily bent and will retain its position.

By way of example only, articles have been constructed in which the size of the facial portion is approximately 4" in width and 4½" in height. The elastomeric material is about 3/16" thick in most portions except those having reinforcing wire therein wherein a minimum of about ⅛" cover exists on all sides of the wire. The wire employed was an 18 guage stainless steel having a polyethylene coating thereon. Such articles can be easily manipulated to assume and retain desired facial expressions of infinite variety. The facial portions of the articles can be made to smile, frown, laugh, squint, stare or any combination of the above. The lips can be spread apart or pressed close together and the eyebrow can be pushed downwardly or upwardly to register anger or surprise, etc.

While the foregoing constitutes a complete description of the preferred embodiment, it will be appreciated by persons skilled in the art that modifications can be made from the preferred embodiment and the scope of protection is to be evaluated solely with respect to the attached claims.

What I claim is:

1. An article of elastomeric material having a facial portion in the form of a facial likeness or a caricature capable of assuming a variety of different facial expressions, said article having eye portions and deformable reinforcement embedded in the elastomeric material and said facial portion, said reinforcement being capable of being manually manipulated to hold the elastomeric material in the selected facial expression, said reinforcement comprising a first reinforcing member extending substantially around the periphery of the facial portion of the article and a second reinforcing member generally in the form of an open ended rectangular loop having its spaced end portion extending transversely across the facial portion of the article and located behind the eyes, said second reinforcing member being affixed to said first reinforcing member.

2. An article of elastomeric material according to claim 1 wherein said eye portions each include a generally conical projection mounted on a surrounding thin wall of flexible elastomeric material, said conical projections each having one end of said spaced ends of said second reinforcing member disposed therein whereby said conical projections may be moved forwardly and rearwardly and laterally with respect to the other portions of said facial portion and will remain in the selected location due to the elastic memory of said second reinforcing member.

3. An article of elastomeric material according to claim 2, wherein a continuous transversely extending portion of said second reinforcing member provides reinforcement extending in the area of said facial portion transversely thereof substantially above the eyebrows.

4. An article of elastomeric material according to claim 3 including a third reinforcing member in said facial portion extending transversely thereof below the lower lip.

5. An article of elastomeric material according to claim 3 wherein said second reinforcing member is affixed to said first reinforcing member at locations adjacent narrow ends of said rectangular loop.

6. An article of elastomeric material according to claim 4 wherein said third reinforcing member provides reinforcement in said facial portion transversely thereof in the area of the upper lip.

7. An article of elastomeric material according to claim 6 wherein said third reinforcing member is affixed at the ends thereof to said first reinforcing member.

8. An article of elastomeric material to claim 1 wherein said reinforcement comprises a wire having a non-toxic plastic coating thereon.

9. An article of elastomeric material according to claim 1 wherein said spaced ends of said second reinforcing member are provided with enlargements to prevent the ends of said reinforcing member from puncturing the elastomeric material.

* * * * *